United States Patent [19]

Chupik

[11] 4,214,405

[45] Jul. 29, 1980

[54] FOUR-WAY DOUBLE DOOR FRAME

[76] Inventor: John M. Chupik, P.O. Box 1008, Temple, Tex. 76501

[21] Appl. No.: 34,961

[22] Filed: May 1, 1979

[51] Int. Cl.[2] ..... E05D 7/02

[52] U.S. Cl. ..... 49/382; 49/501; 49/504; 52/207

[58] Field of Search ..... 49/504, 382, 366, 501; 52/204, 207

[56] References Cited

U.S. PATENT DOCUMENTS

| | | | |
|---|---|---|---|
| 3,811,238 | 5/1974 | Brinker | 52/204 |
| 3,889,423 | 6/1975 | Begin | 49/504 |
| 4,068,433 | 1/1978 | Glover | 52/207 |
| 4,167,088 | 9/1979 | Governale | 52/207 |

*Primary Examiner*—Kenneth Downey

*Attorney, Agent, or Firm*—James H. Littlepage

[57] ABSTRACT

A frame for a double door, one door fixed and the other pivoted, permits the pivoted door to be mounted on a center mull either with left- or right-handed orientation, and to swing inwardly or outwardly.

5 Claims, 15 Drawing Figures

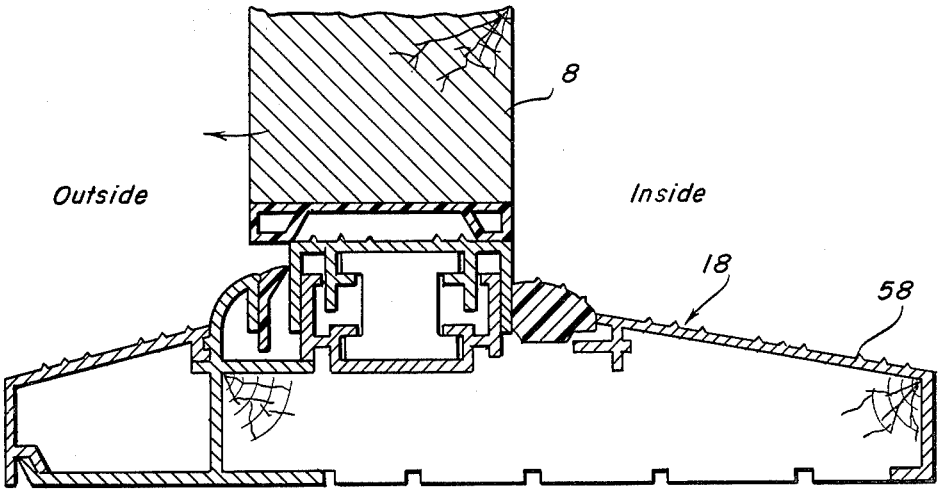
Fig. 14
Fig. 15
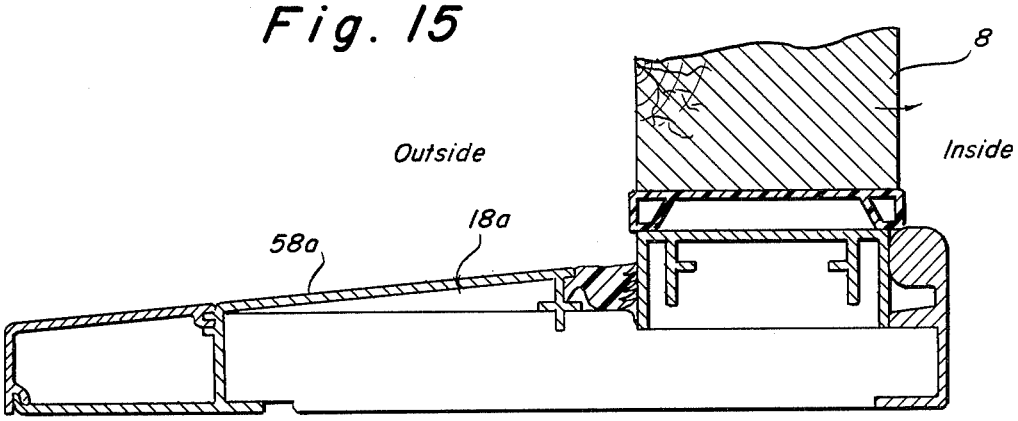

FOUR-WAY DOUBLE DOOR FRAME

FIELD OF INVENTION

Movable or Removable Closures with means mounting closure for swinging, hinging position reversal means.

PRIOR ART

Klein et al U.S. Pat. No. 1,806,467; Heijmer et al U.S. Pat. No. 2,541,871; Kuehnlein U.S. Pat. No. 2,929,446; and Brooks U.S. Pat. No. 3,458,955.

OBJECTS

Heretofore, no-handed door frames, some adapted for inward or outward swinging of a door have been provided, but so far as is known, they have been comprised of relatively complex or multiple parts which are not easily assembled on the job by unskilled workmen. The primary object of this invention is to provide a frame for double door, one door fixed and the other pivoted, having a relatively few simple parts which can be shipped in knockdown form and easily and simply assembled and installed on the job. The essence of the invention is in the reversability of all parts of the frame, save for the sill, to provide for either the left- or right-hand orientation of the swinging door or the inward or outward swinging thereof. To this end is intended now to provide a double door frame having a single center mull having a single set of hinge mortises in which the hinges for the swinging one of the double doors are mounted, and which mull can be inverted 180° end-for-end about its transverse axis and/or turned 180° about its longitudinal axis so as to dispose the hinge mortises for either inward or outward swinging of the door or for left- or right-hand orientation of the door. A further object is to provide head jamb and side jamb frame members which, like the center mull, can be reversed so as to be compatible with the hand orientation or in- or out-swinging of the pivoted one of the double doors.

These and other objects will be apparent from the following specification and drawings, in which.

Figure 1:
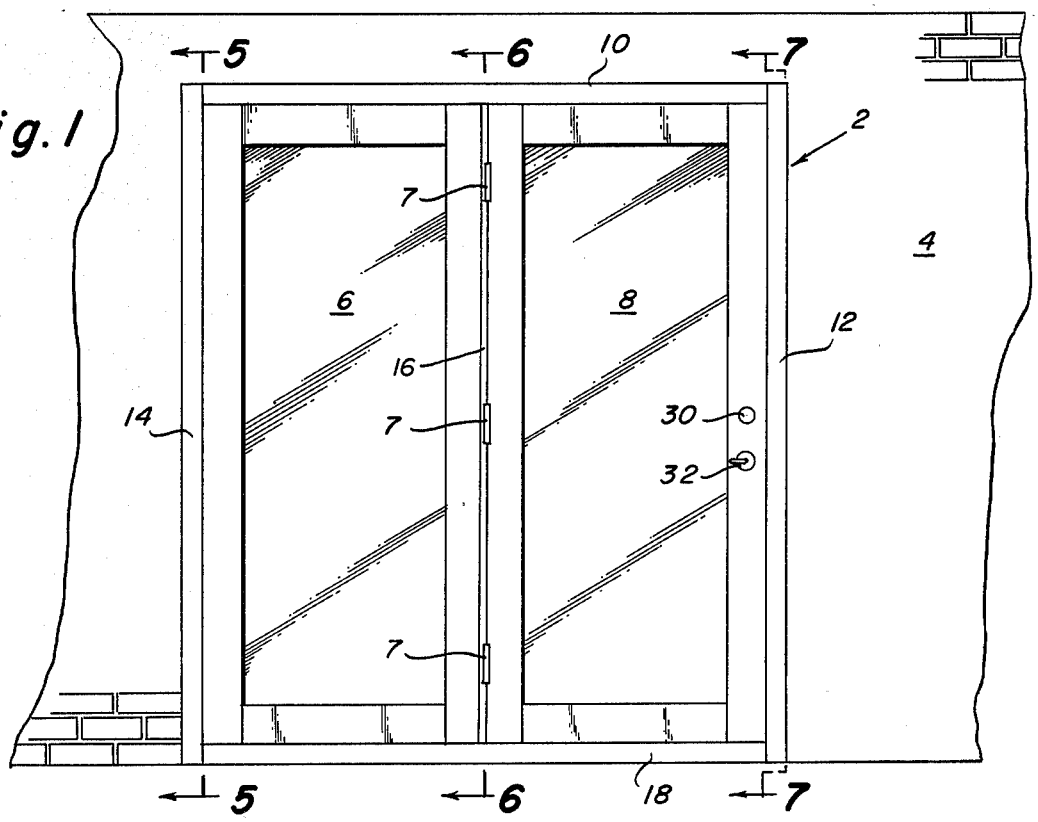
FIG. 1 is an elevational view from the outside of a building showing the double door assembly, one door fixed and one door swinging, wherein the swinging door is to the right, as seen from the outside, and mounted for right-hand out-swing.
Figure 2:
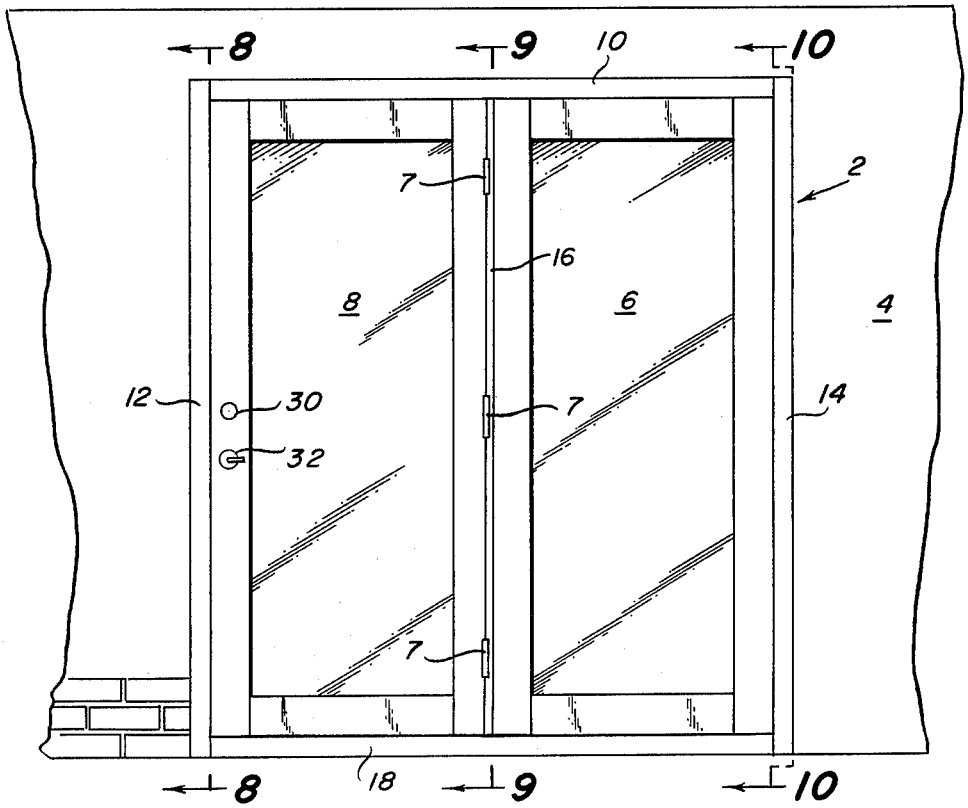
FIG. 2 is a view similar to FIG. 1, but showing the swinging one of the double doors mounted for left-hand out-swing.
Figure 3:
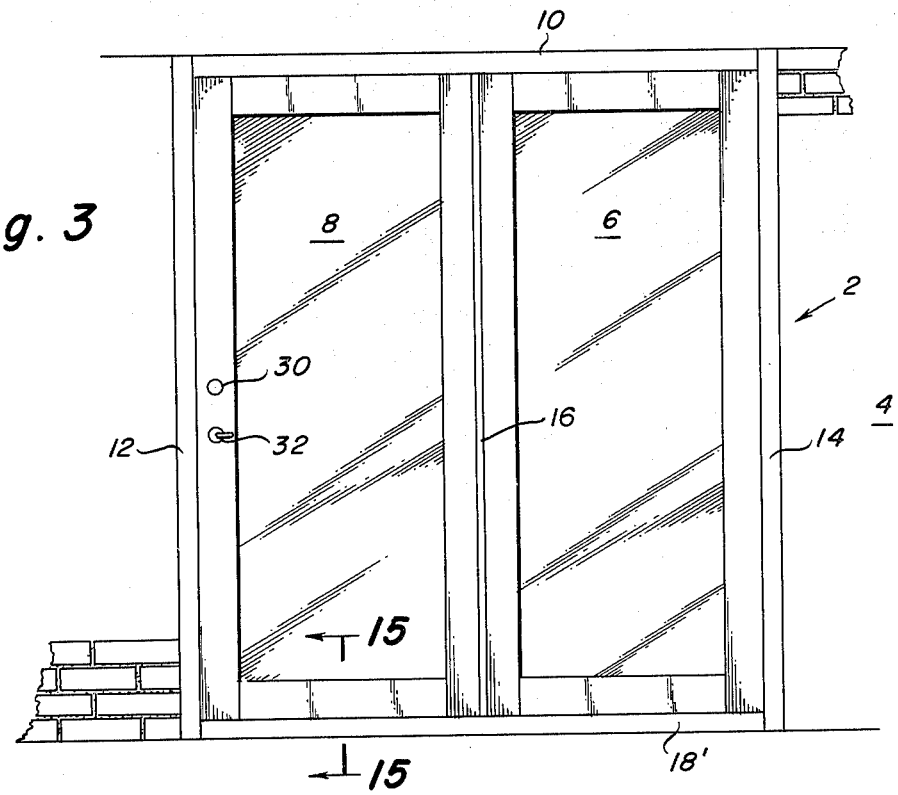
FIG. 3 is a view similar to FIGS. 1 and 2, but showing the swinging one of the double doors mounted for left-hand in-swing.
Figure 5:
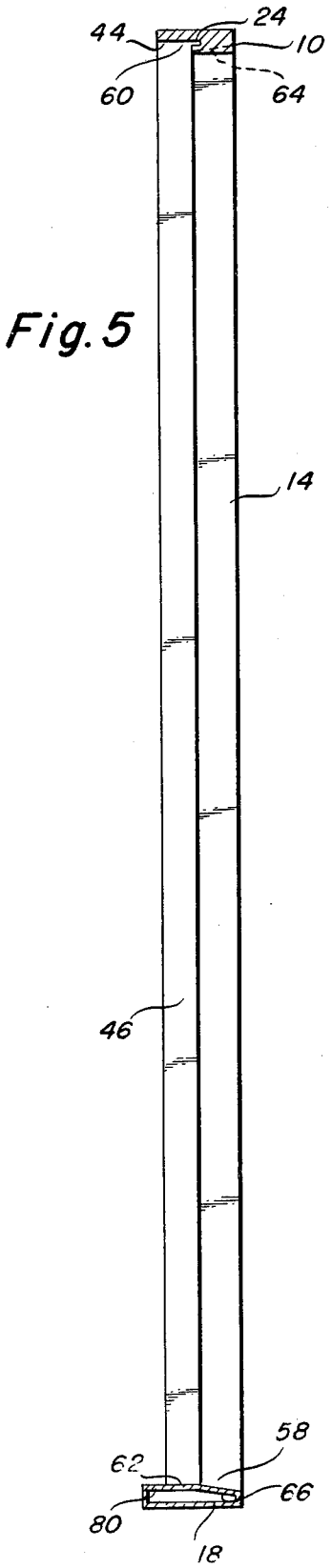
Figure 6:
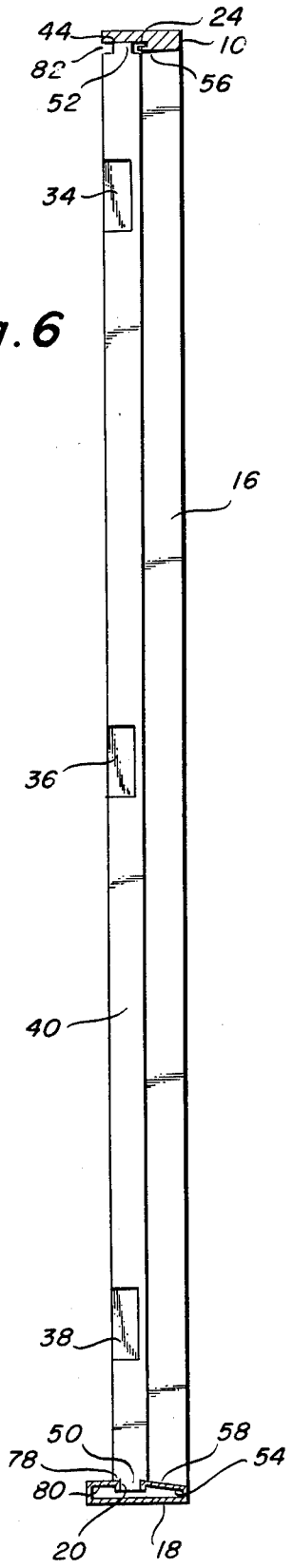
Figure 7:
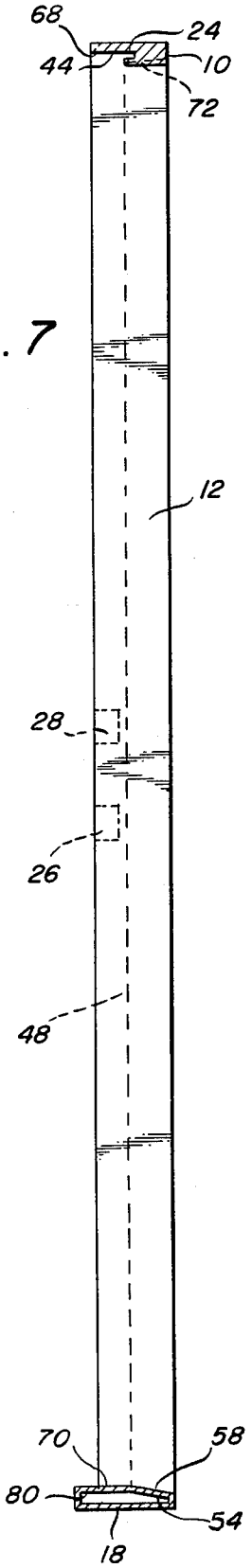
Figure 8:
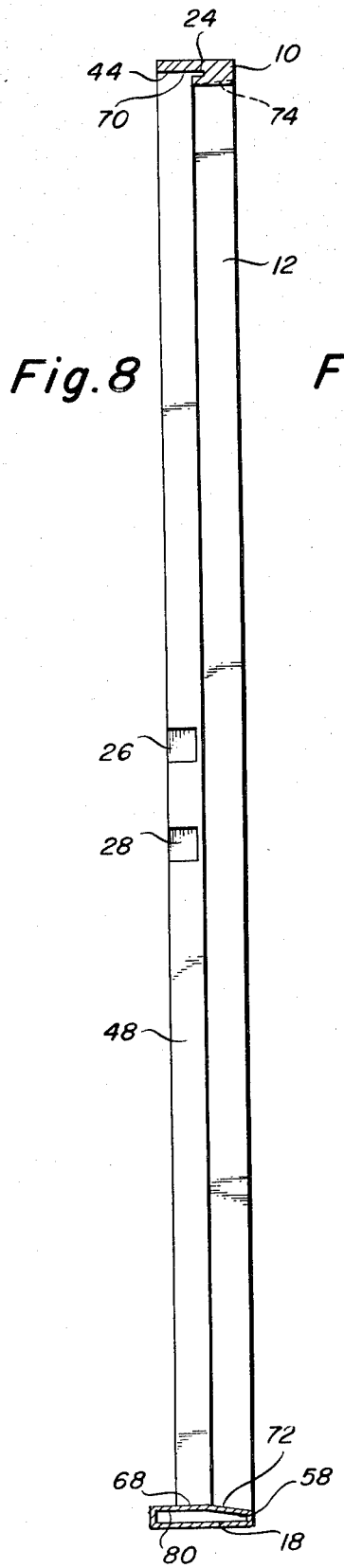
Figure 9:
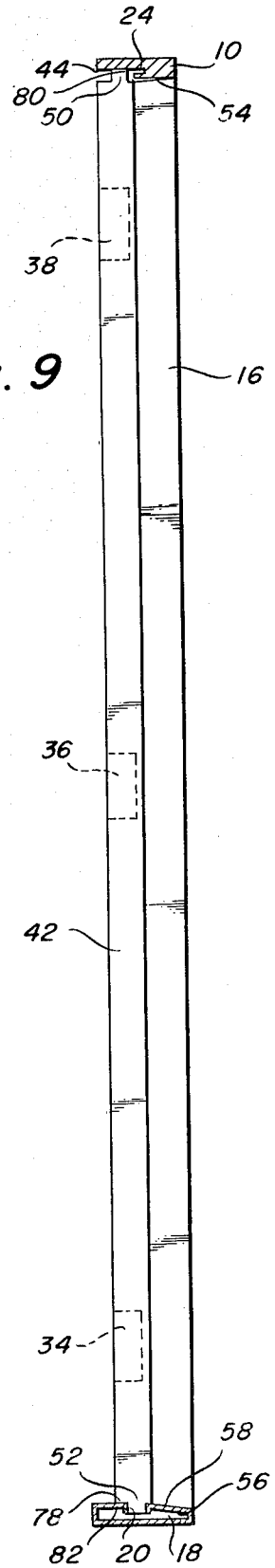
Figure 10:
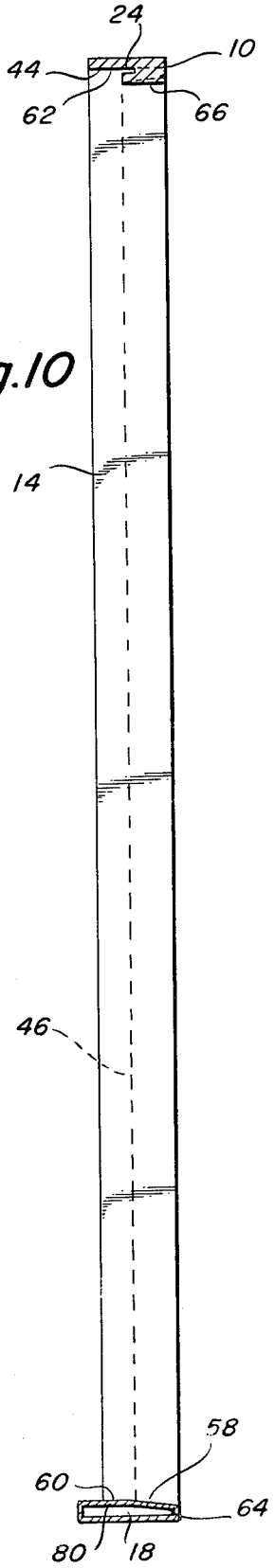
Figure 11:
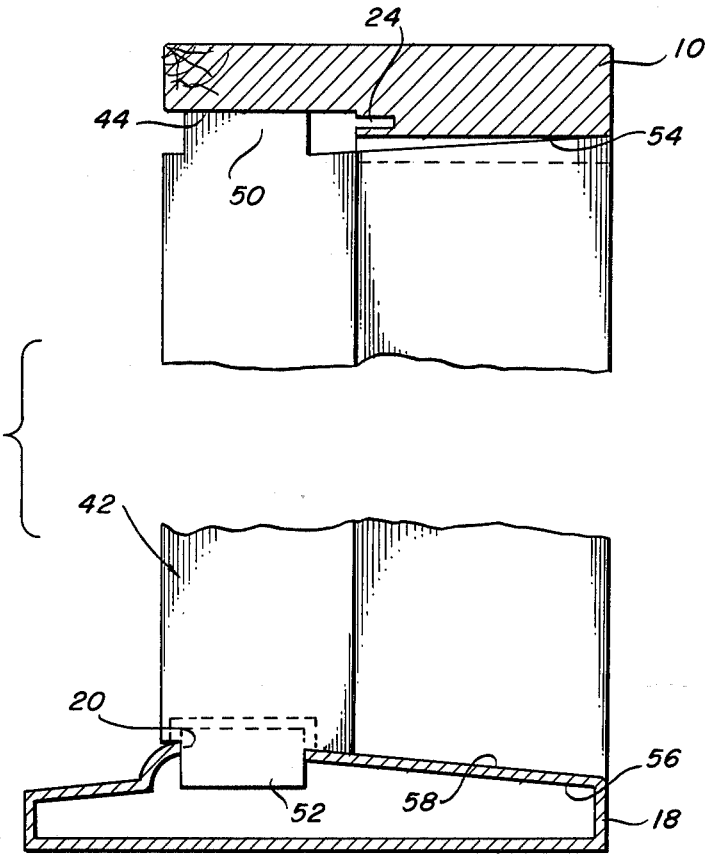
Figure 12:
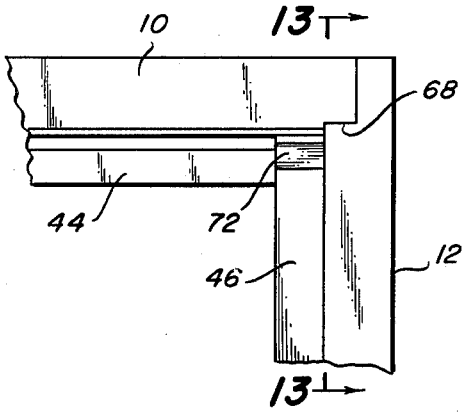
Figure 13:
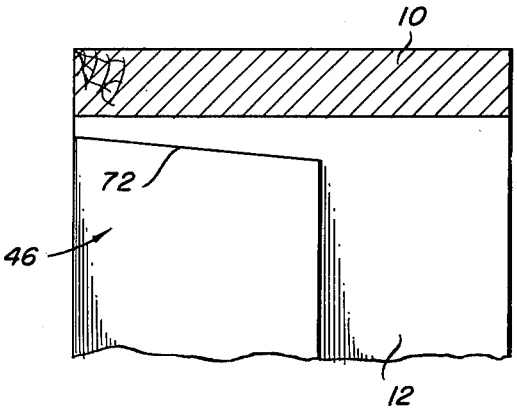

FIGS. 5, 6 and 7 are cross sections along the lines 5—5, 6—6 and 7—7 of FIG. 1;

FIGS. 8, 9 and 10 are cross sections along the lines 8—8, 9—9 and 10—10 of FIG. 2;

FIG. 11 is a broken-away view showing the upper and lower ends of the center mull in elevation and the head jamb and sill in cross section, arranged for out-swing of the pivoted door;

FIG. 12 is a fragmentary elevational view showing the corner joint between the head and strike jambs;

FIG. 13 is a cross section along the line 13—13 of FIG. 12;

FIG. 14 shows a typical sill designed for out-swinging doors; and,

FIG. 15 is a cross section along the line 15—15 of FIG. 3 showing a typical sill for an in-swinging door.

Referring now to the drawings, in which like referenced numerals denotes similar elements, and with particular reference to FIGS. 1–4, there are shown a double door frame 2 mounted in a building wall 4, a fixed door 6 and hinges 7 mounting a swinging door 8. The main pieces for the door frame are a head jamb 10, a strike jamb 12, a fixed-door jamb 14, and a center mull 16. While the details of the sill portion of the assembly form no part of the invention, because sills of various design can be used, the requirements are that it has an inclined tread and a notch for a tongue on a center mull as described hereinafter. Such a notch 20 is shown in FIG. 11.

Notch 20 receives a tongue 50 or 52 on one or the other ends of the center mull 16, and the head jamb 10 is provided at its center with a notch to house the beveled face on one of the other ends of the center mull, as hereinafter detailed.

All the door frame members, save for the sill, are provided with a kerf 24 for receiving weather stripping (not shown). The strike jamb 12 is provided with mortises 27 and 28 for receiving the bolt of a lock 30 or the latch associated with knob 32. A suitable striker plate (not shown) may be applied over mortises 26 and 28, it being apparent by comparing FIGS. 7 and 8 with one another that the mortises 26 and 28 are symmetrically disposed on either side of the longitudinal center of the jamb; that is to say, if a strike jamb 12 is inverted from its FIG. 7 to its FIG. 8 position, the mortise 27 is disposed at the same height as was mortise 28 prior to inversion of the strike jamb; and the same for mortise 28. The same principle applies to hinge mortises 34, 36 and 38 for the center mull 16; namely, hinge mortise 36 is always at the mid-point of the length of the center mull and hinge mortises 34 and 38 are symmetrically disposed along the lengths of the center mull. The center mull 16 has door rabbets 40 and 42 along each side and the head jamb 10, striker jamb 12 and fixed jamb 14 each have door rabbets 44, 46 or 48 along one side.

Figure 4:
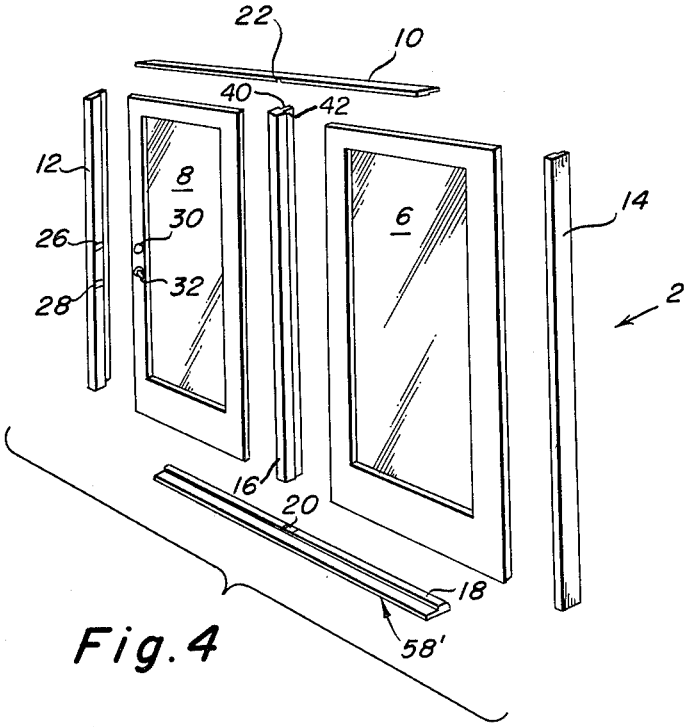
FIG. 4 is an exploded view of the door and frame members arranged for right-hand in-swing.

The center mull 16 has tongues 50 and 52 on its opposite ends, and beveled-end faces 54 and 56 on each end. The tongues are for engagement in the notch 20 in the center of the sill 18 (FIGS. 4, 9, and 11). When the tongue 52, for example, engages in the sill notch 20, the tongue 50 on the opposite end engages against the longitudinal horizontal surface of the rabbet 44 in head jamb 10 (FIG. 11). The beveled end faces serve no useful purpose on the end of the center mull which is uppermost, but on the end of the center mull which is lowermost, they fit against the sloping tread 58 or 58' on the sill. In the upper portion of FIG. 11 it will be apparent that the upper edge of the beveled surface 54 engages against the downwardly facing surface of the head jamb 12 so that the sloping surface is not visible at the top of the mull.

The fixed-door jamb 14 has straight-across rabbets 60 and 62 across each end and downwardly and laterally offset beveled rabbets 64 and 66 across its thicker part. Likewise, the strike jamb 12 has straight-across rabbets 68 and 70 at each end and downwardly and laterally offset rabberts 72 and 74 across the thicker part thereof. As in the case of the center mull, the beveled rabbets serve no purpose at the ends of the jambs which are uppermost, but at the lowermost end they fit against the inclined tread surface 58 or 58' of the sill 18 or 18'. Center mull 16 has notches 80 and 82 at opposite ends. For the end of the center mull which is downwardly disposed, notch 80 forms a joint over the flat face 78 of the sill.

The details of the sill do not form any part of the invention except as previously noted. Various types and models may be used. FIGS. 14 and 15 illustrate typical sills useable for either an out-swinging door (FIG. 14) or an in-swinging door (FIG. 15). It will be understood that the rabbets and bevels on the fixed and strike jambs and the center mull will be appropriately cut so as to be compatible with the particular type of sill utilized, and that the sill will be suitably notched to accommodate the tongue 50 or 52 in the center mull.

The operation of the invention is as follows:

Assume the door and door frame parts to be arranged as illustrated in FIG. 1, wherein the door is for right-hand out-swing. If a left-hand in-swinging door is desired, sill 18 would be replaced with a sill 18' and all of the other door frame parts and doors would be reversed by swinging them 180° about the center vertical axis. The parts would then appear as in FIG. 3. If, however, a left-hand out-swing for door 8 is desired, the center mull 16 would be inverted 180° about its transverse axis and also rotated 180° about its longitudinal axis. This, of course, would face the hinge mortises to the left, as seen in FIG. 2. Strike jamb 12 would be placed on the left-hand side of the frame, as in FIG. 2, and inverted 180° about its transverse axis, and fixed door jamb 14 would be placed on the right-hand side of the assembly, as in FIG. 2, and also rotated 180° about its transverse axis. Thus, all of the door rabbets would face outwardly. Head jamb 10 would be rotated about its transverse axis so that its door rabbet would face outwardly. FIGS. 5 through 10 illustrate the relative positions of the frame members for out-swing. It should be understood that for the in-swinging examples, all of the door rabbets face inwardly.

What is claimed is:

1. A four-way double door frame for a pair of doors, one of which is fixed and the other swinging, wherein the swinging door may be either left- or right-handed and may be either in-swinging or out-swinging, comprising:

a head jamb, a fixed-door jamb, a strike jamb for the swinging door, a sill, and a center mull, said jambs all having a door-rabbet portion adjacent one longitudinal edge and an unrabbeted portion adjacent the other longitudinal edge, said center mull having oppositely disposed door-rabbet portions on respectively opposite sides thereof adjacent one longitudinal edge and an unrabbeted portion adjacent the other longitudinal edge, and a plurality of hinge mortises symmetrically placed along the length of one rabbeted portion, and joint means at opposite ends of the fixed-door jamb, the strike jamb, and the center mull for joining either end thereof selectively to either the sill or the head jamb.

2. A four-way double door frame for a pair of doors, one of which is fixed and the other swinging, wherein the swinging door may be either left- or right-handed and may be either in-swinging or out-swinging, comprising:

a head jamb, a fixed-door jamb, a strike jamb for the swinging door, a sill, and a center mull, said jambs all having a door-rabbet portions adjacent one longitudinal edge and an unrabbeted portion adjacent the other longitudinal edge, said center mull having oppositely disposed door-rabbet portions on respectively opposite sides thereof adjacent one longitudinal edge and an unrabbeted portion adjacent the other longitudinal edge, and a plurality of hinge mortises symmetrically placed along the length of one rabbeted portion, and joint means at opposite ends of the fixed-door jamb, the strike jamb, and the center mull for joining either end thereof selectively to either the sill or the head jamb, said sill having an inclined tread surface adjacent a longitudinal edge thereof and a horizontal surface adjacent an opposite longitudinal edge, said joint means at the opposite ends of said fixed door jamb, said strike jamb, and said center mull including beveled end surface means for fitting against the inclined tread surface of the sill and horizontal end surface means for fitting against the horizontal tread surface of the sill and alternately against a horizontal lower surface of the head jamb.

3. A four-way double door frame for a pair of doors, one of which is fixed and the other swinging, wherein the swinging door may be either left- or right-handed and may be either in-swinging or out-swinging, comprising:

a head jamb, a fixed-door jamb, a strike jamb for the swinging door, a sill, and a center mull, said jambs all having a door-rabbet portions adjacent one longitudinal edge and an unrabbeted portion adjacent the other longitudinal edge, said center mull having oppositely disposed door-rabbet portions on respectively opposite sides thereof adjacent one longitudinal edge and an unrabbeted portion adjacent the other longitudinal edge, and a plurality of hinge mortises symmetrically placed along the length of one rabbeted portion, and joint means at opposite ends of the fixed-door jamb, the strike jamb, and the center mull for joining either and thereof selectively to either the sill or the head jamb, said sill having an inclined tread surface adjacent a longitudinal edge thereof, said joint means at the opposite ends of said fixed door jamb, said strike jamb, and said center mull including beveled end surface means for fitting against the inclined tread surface of the sill, said sill having an upwardly open notch intermediate the end thereof, the joint means at opposite ends of said center mull including a tongue projecting lengthwise from each end thereof for engaging in the notch in the sill.

4. A four-way double door frame for a pair of doors, one of which is fixed and the other swinging, wherein the swinging door may be either left- or right-handed and may be either in-swinging or out-swinging, comprising, a head jamb, a fixed-door jamb, a strike jamb for the swinging door, and a sill having an upwardly open notch intermediate the ends thereof and inclined tread surface extending lengthwise thereof between the notch and one longitudinal edge thereof, said jambs all having a door rabbet portion adjacent one longitudinal edge thereof and an unrabbeted portion along the other longitudinal edge thereof and each of the fixed door and strike jambs having joint means at opposite ends for joining selectively to the sill or to the head jamb, a center mull having oppositely disposed door rabbet portions on respectively opposite sides adjacent one longitudinal edge thereof, and an unrabbeted portion adjacent the other longitudinal edge thereof, the center mull being relatively thin between the door rabbeted portions and relatively thick in the unrabbeted portion, a plurality of hinge mortises symmetrically spaced along the length of one door rabbeted portion, a beveled end surface at each end of the relatively thick portion adapted to fit against the inclined tread surface, and a tongue extending longitudinally beyond each end of the relatively thin portion adapted to engage in the notch in the sill, whereby either end of the center mull may be mounted on the sill with the hinge mortises disposed in either longitudinal direction of the sill for left- or right-hand orientation of the swinging door, or for either in-swing or out-swing of the swinging door.

5. A four-way double door frame as claimed in claim 4, the joint means at each end of the fixed door jamb and striker jambs including beveled ledge means on the un-rabbeted portion for engagement on the inclined tread surface at an end of the sill.

* * * * *